US005655325A

United States Patent [19]

Watkins

[11] Patent Number: 5,655,325

[45] Date of Patent: Aug. 12, 1997

[54] CONFETTI LAUNCHING BANNERS

[76] Inventor: James O. Watkins, 14920 Mt. Nebo Rd., Poolesville, Md. 20837

[21] Appl. No.: 589,891

[22] Filed: Jan. 23, 1996

[51] Int. Cl.[6] ..... G09F 7/22

[52] U.S. Cl. ..... 40/617; 446/475; 160/243

[58] Field of Search ..... 446/475; 40/617, 40/216, 603, 604; 472/52, 137; 248/320; 160/243

[56] References Cited

U.S. PATENT DOCUMENTS

| | | | |
|---|---|---|---|
| 262,609 | 8/1882 | Myrick | 160/243 X |
| 825,843 | 7/1906 | Kliemandt | 446/475 X |
| 1,084,636 | 1/1914 | Hünerkopf | 446/475 |
| 1,260,585 | 3/1918 | Simon | 160/243 X |
| 1,941,383 | 12/1933 | Benson | 160/243 X |
| 1,963,830 | 6/1934 | Corbet | 160/243 X |
| 2,932,469 | 4/1960 | Yost | 40/216 X |
| 4,787,160 | 11/1988 | Balsamo | 446/475 X |
| 5,199,745 | 4/1993 | Balsamo | 446/475 X |
| 5,263,890 | 11/1993 | Dent, IV | 446/475 |
| 5,304,096 | 4/1994 | Wilk | 472/137 |
| 5,354,227 | 10/1994 | Watkins | 446/475 |

FOREIGN PATENT DOCUMENTS

| | | | |
|---|---|---|---|
| 360280 | 4/1906 | France | 446/475 |
| 341784 | 1/1931 | United Kingdom | 446/475 |

*Primary Examiner*—Joanne Silbermann
*Attorney, Agent, or Firm*—Ronald B. Sherer

[57] ABSTRACT

A rolled banner containing confetti in the rolled layers of the banner is disclosed including apparatus for releasing the rolled banner such that the banner may be unrolled upon command whereby a message or other indicia on the banner is displayed simultaneously with the confetti bursting into the air.

15 Claims, 2 Drawing Sheets

CONFETTI LAUNCHING BANNERS

FIELD OF THE INVENTION

This invention relates to the launching of confetti into the air, and more particularly, to the launching of confetti by means of furled banners containing confetti which banners are unfurled in the air upon command such that the message on the banner is displayed and the confetti bursts out of the banner into the air.

BACKGROUND

It is known that confetti can be launched into the air by hand-throwing bundles of confetti as disclosed in U.S. Pat. No. 5,352,148, or by launching from compressed-gas cannons such as disclosed in copending application Ser. No. 08/111,608, now U.S. Pat. No. 5,529527or by ejection from a hand-held, hollow tube as disclosed in U.S. Pat. No. 5,403,225, or by ejection from a hand-held wand as disclosed in copending application Ser. No. 08/368,500, now U.S. Pat. No. 5,556,319; all of said patents being incorporated herein by reference. All of these methods are effective in launching confetti into the air, and they add great pleasure and amusement at festive occasions such as concerts, ball games, amusement parts, and other public and private celebrations. At the same time, there has been a need for a confetti launching system which is uniquely suitable for commercial or corporate functions, and particularly for promotions of commercial products and services, and one which may be used both indoors and outdoors, and which may be operated without professional personnel and without any participation by the audience.

SUMMARY

The present invention achieves all of the above advantages by providing a rolled or furled banner displaying a corporate name, advertising message, trademark and/or logo, or other message or greeting, and with confetti rolled inside the banner such that, when the banner is unfurled by simple release means, the logo and/or message on the banner is suddenly displayed while, at the same time, a burst of confetti is simultaneously launched into the air.

DETAILED DESCRIPTION OF PREFERRED EMBODIMENTS

Figure 1:
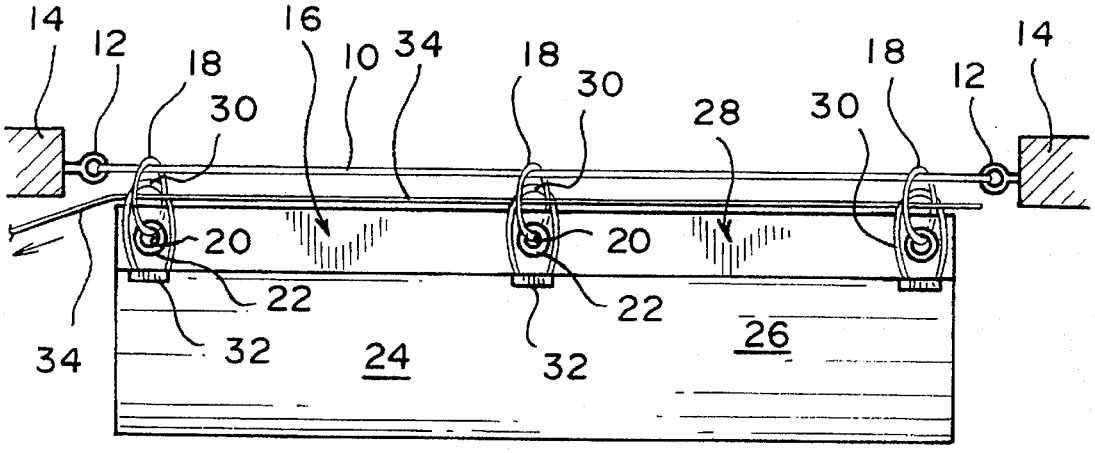
FIG. 1 is a schematic illustration of a rolled banner containing confetti which is supported in the air prior to unrolling the banner.

Referring to FIG. 1, numeral 10 indicates an elongated support which may be a cable, rope, wire or elongated rod or tube which may be supported between anchors 12 secured to stationary structures 14. It will be understood that anchors 12 may be hooks, clamps, sockets or other conventional mounting means secured to structures such as walls, beams or other structural portions of the room, theater or other indoor or outdoor facility where a given event is being conducted. A banner 16 composed of cloth, plastic or the like is hung from support 10 by a plurality of hangers 18. Hangers 18 may comprise annular or oval-shaped rings which pass around support 10 and through holes 20 in the upper portion 21 of the banner. In this regard, it is preferred that the upper portion of banner 16 be hemmed and provided with grommets 22 surrounding holes 20 for added strength in supporting the weight of the banner and the confetti rolled therein.

Figure 2:
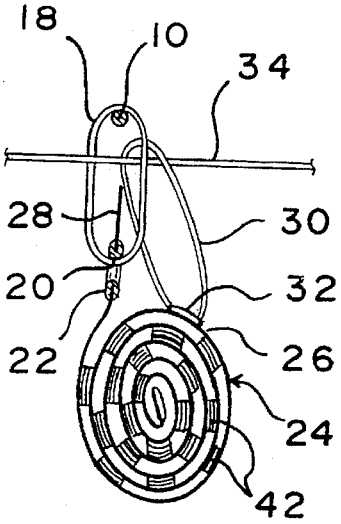
FIG. 2 is a schematic, side elevational view of the rolled banner showing the support structure in enlarged detail.

As shown in FIGS. 1 and 2, the banner is rolled lengthwise to form a roll 24, and the upper backside 26 of the banner is brought to a position adjacent the upper portion 28 of the banner. The upper backside of the rolled banner includes a second plurality of support rings 30 which may be secured to the upper backside of the banner by sewing, or by adhesive, or by reinforcement strips 32. After securing the upper portion 28 of the rolled banner to support 10, and bringing backside 26 close to upper portion 28, a release or trigger line 34 is passed through each of hangers 18 and its associated support ring 30 such that the rolled banner is secured in rolled or furled condition from support 10. Thus, it will be understood that, so long as release line 34 extends through and between hangers 18 and support rings 30, the support rings are secured in this position and the banner cannot unroll. It will also be understood that hangers 18, support rings 30 and release line 34 are shown as being spaced apart from each other in the drawings for purposes of clarity in distinguishing these elements. In practice, it will be apparent that support rings 30 pull against release line 34 which, in turn, pulls against hangers 18. Thus, the weight of the banner frictionally clamps the release line between the hangers and the support rings until such time as the line is pulled from between support rings 30 and hangers 18 by a force sufficient to overcome the frictional clamping force on the release line. In this regard, it will be understood that support rings 30 are shown as being oversized and elongated in the drawings for purpose of clarity, and that alternatively, each of support rings 30 may be connected to backside 26 of the roll by intermediate straps or loops of cord if desired. That is, rings 30 may be smaller than shown and reinforcing strips 32 may comprise elongated straps or cords.

Figure 3:
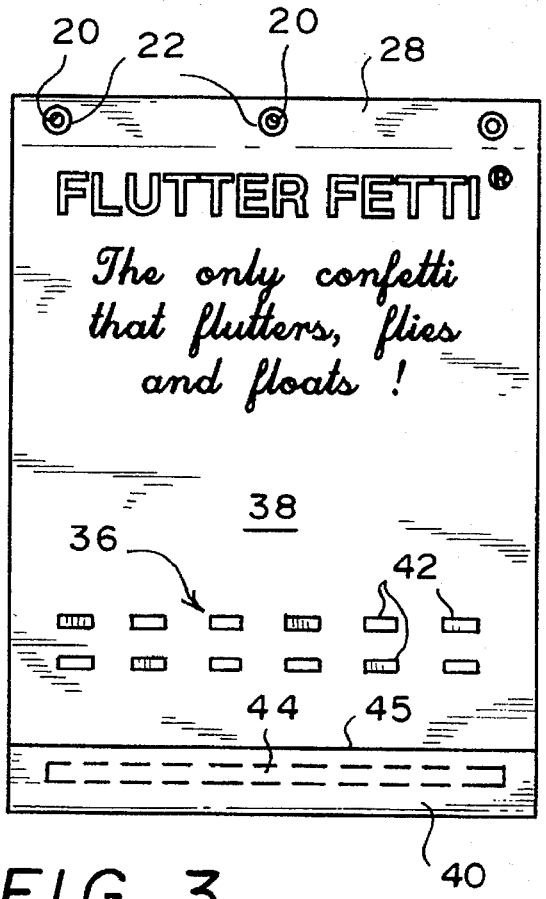
FIG. 3 is a schematic, top plan view of the banner prior to rolling the banner with confetti contained therein.

As shown in FIG. 3, confetti 36 may be incorporated into the banner by placing the banner on a flat surface, such as a table or floor, and placing or sprinkling confetti 36 on the upper surface 38 of the unrolled banner, followed by rolling the banner from the bottom portion 40 toward the top portion 28. While conventional confetti of round or irregular shape may be sprinkled on upper surface 38 of the banner, in the preferred embodiment of the present invention, unwrapped stacks 42 of FLUTTER FETTI® confetti comprising elongated tetragonal-shaped confetti, as more fully disclosed in U.S. Pat. Nos. 5,352,148 and 5,403,225, are placed in rows across the width of the upper surface of the banner. For example, each stack of FLUTTER FETTI confetti may comprise 50 to 500 or more pieces of confetti such that, in a banner having only a four foot width, 12 to 24 or more stacks may be positioned in each row. The number of rows of stacked confetti may be, for example, in the order of one row per 6 or 12 inches of the length of the banner such that, even for a relatively small 4×8 foot banner, the number of pieces of confetti may be in the order of 4,800 to 144,000 or more as desired. It will also be understood that each piece of elongated tetragonal-shaped FLUTTER FETTI confetti rotates about its axis as it falls through the air, and FLUTTER FETTI confetti has a hang time in the order of 4 or 5 times that of conventional confetti. Thus, upon suddenly unrolling the banner, the message is displayed with a virtual snow storm and burst of confetti slowly fluttering to the ground.

As further shown in FIG. 3, the bottom end portion 40 of the banner is preferably provided with an additional weight 44. Weight 44 may be sewn into a hem 45 of the banner, or otherwise secured thereto, and the weight may comprise a relatively heavy solid, such as a metallic rod or bar extending across all or a portion of the width of the bottom of the banner. Alternatively, the weight may comprise loose sand or individual small weights such as lead shot or sinkers which may be sewn into the hem or in a plurality of pockets along the bottom portion 40 of the banner.

As will be understood from FIGS. 1 and 2, when trigger or release line 34 is pulled to the left as viewed in FIG. 1, either by hand-pulling or by mechanical means as hereinafter described, the trigger line is removed from its locking position between support rings 30 and hangers 18 such that the rolled portion 24 of the banner is suddenly released. The banner then unrolls downwardly very rapidly and the confetti bursts out in a giant display of confetti as the message on the banner is simultaneously displayed.

It has also been discovered that by using a weight 44 such as previously described, the falling weight produces a sharp pulling force, or snap-action, on the banner at the moment that the banner becomes fully unrolled. This sharp pulling or snap-action produces a waving of the banner just as the last of the confetti is launched, and the wave action of the banner causes any pieces of confetti which may be clinging to the banner, such as by reason of static electricity and/or humidity, to be suddenly released along with the last of the confetti thereby adding to the visual effect in impressing the banner's message on the audience.

Figure 4:
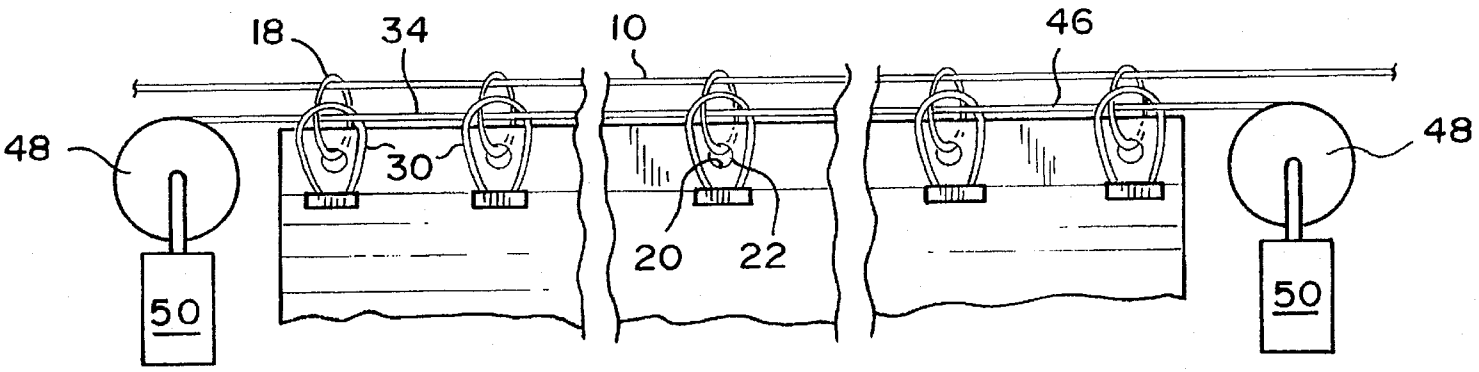
FIG. 4 is a schematic, partial view of the top portion of a rolled banner illustrating an alternative release system.

In the foregoing embodiment, it will be apparent that as trigger line 34 is pulled to the left, as viewed in FIG. 1, the right side of the banner is released first, then the middle portion of the banner and then the left side of the banner. This progressive releasing of the banner is quite effective, and may be pulled from a remote location, and is preferred for banners having a relatively narrow width such as up to 8 feet wide. However, for banners having greater widths, it is preferred that the release system be capable of releasing essentially the full width of the banner at substantially the same time. One such releasing system is illustrated in FIG. 4 wherein two release lines 34, 46 are shown as extending through support rings 30 and hangers 18 from opposite sides of the banner. While these lines may be manually pulled from a remote location as previously described, for large banners it is preferred that the release lines be actuated by mechanical means such as pulleys 48 driven by motors 50. In this manner, banners of large width may be unfurled almost instantly across their entire width upon closure of a single, remotely-located switch which energizes the motors.

Figure 5:
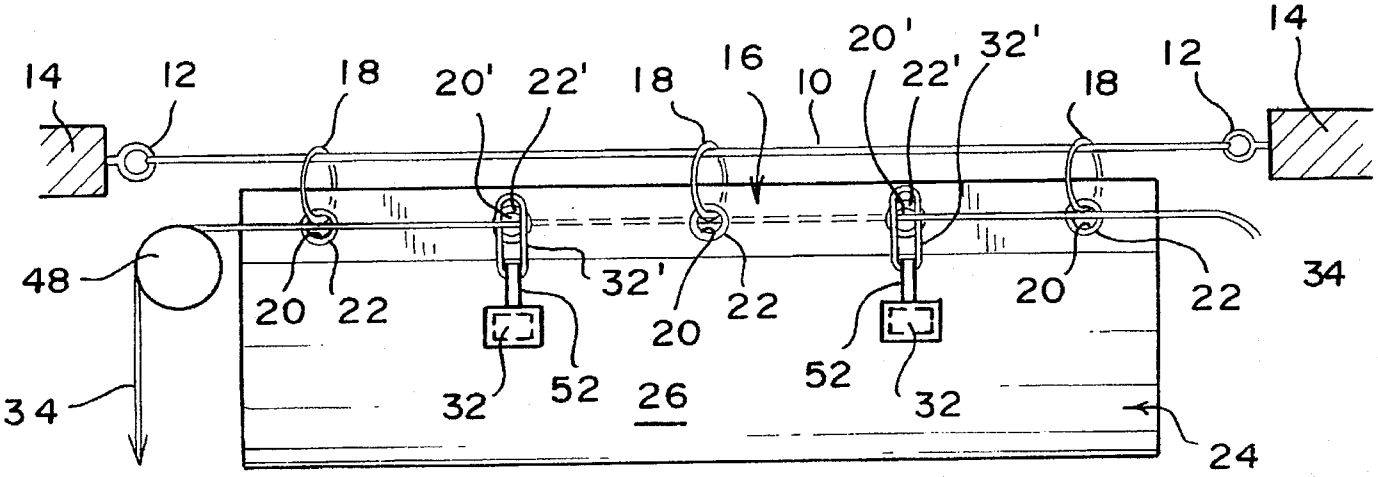
FIG. 5 is a schematic view of a rolled banner illustrating a second alternative release system.

Another preferred embodiment of the present invention is shown in FIG. 5 in which the same elements previously described are indicated by the same numerals. However, instead of extending release line 34 through hangers 18 and support rings 32 as previously described, an additional plurality of holes 20' are provided in the upper portion of the banner, and holes 20' are preferably surrounded by grommets 22'. Support rings 32' may be as previously illustrated, or they may be smaller rings secured at the ends of straps or cords 52 the opposite ends of which are secured to the upper backside 26 of roll 24. In either event, release line 34 is passed through holes 20' and support rings 32' such that the banner is secured in the rolled condition as previously described. Release line 34 may also pass through holes 20, but it will be understood that the rolled banner is secured whether or not the line passes through holes 20 because it is the frictional clamping of the release line by support rings 32' and holes 20' which secures the banner in rolled condition.

While this alternative embodiment requires the nominal cost of an additional set of holes 20', and preferably grommets 22', this is more than offset by the advantage that the banner may be filled with confetti, rolled and secured by release line 34 at a factory location, and then shipped to the site pre-rolled and secured by the release line. The rolled banner may then be hung from support 10 on hangers 18 without disturbing release line 34, and without requiring other means to keep the banner rolled while being hung on hangers 18. 0f course, instead of a single release line 34 as illustrated in FIG. 5, a dual release line system may be used as previously described with respect to FIG. 4, and the release line or lines may be actuated manually or by a motorized pulley or pulleys as previously described.

From the foregoing description of several preferred embodiments of the present invention, it will be apparent that the present invention provides a simple, low-cost confetti launching system which enables a corporate or advertising message to be suddenly displayed while thousands, and even millions, of pieces of confetti are simultaneously launched into the air with a dramatic display which impresses the message into the mind of the audience. At the same time, it will be apparent that the present invention is in no way limited to corporate or advertising messages, and the confetti-filled banner may display any message such as, for example, "Happy Birthday!", or "Happy New Year!", or the name of a sports team such as at half-time shows, or any message or indicia as may be desired.

It will also be apparent that, although the use of simple release lines, such as release lines 34 and/or 46 are preferred from the standpoint of simplicity and low-cost, it will be apparent to those skilled in the art that many other forms of release systems may be employed in the present invention. For example, the rolled banner may be fully or partially surrounded by an outer wrapper, or by a plurality of straps or cords, the latter of which may be released thereby allowing the banner to unroll. Similarly, the release system may comprise a plurality of hooks, clamps, or locking pins which are actuated either manually or by remote control of solenoids, for example, to release and unfurl the banner with an accompanying burst of confetti like fireworks in the air.

Therefore, it is to be understood that the foregoing description of several preferred embodiments of the invention is intended to be illustrative of the principles of the invention, rather than exhaustive thereof, and that the invention is not intended to be limited thereby, or to be limited other than as expressly set forth in the following claims as interpreted under the doctrine of equivalents.

What is claimed is:

1. A confetti launching banner comprising:

(a) a banner having a width, a length and top and bottom portions;

(b) indicia means on said banner;

(c) first support means for supporting said top portion of said banner in the air;

(d) said banner being rolled along said length to form rolled layers such that said bottom portion is adjacent said top portion;

(e) second, releasable support means for supporting said rolled bottom portion adjacent said top portion;

(f) a large plurality of pieces of confetti contained between said rolled layers; and (g) means for releasing said second support means and unrolling said banner downwardly to release said confetti into the air and simultaneously display said indicia means, said means for releasing said second support means comprising a release line passing through said second support means.

2. The confetti launching banner of claim 1 wherein said second support means include a plurality of support rings secured to said rolled banner.

3. The confetti launching banner of claim 2 wherein said means for releasing said second support means comprise a trigger line passing through said plurality of support rings.

4. The confetti launching banner of claim 2 wherein said plurality of support rings are connected to said rolled banner by a plurality of reinforcement strips.

5. The confetti launching banner of claim 1 wherein said confetti comprises rows of confetti extending across at least the major portion of the width of said banner.

6. The confetti launching banner of claim 5 wherein said rows of confetti comprise rows of stacks of elongated tetragonal-shaped confetti.

7. A confetti-filled advertizing banner comprising:

(a) a banner having a width, a length and top and bottom portions;

(b) advertizing indicia on said banner;

(c) said banner being rolled lengthwise to form rolled layers such that said bottom portion is adjacent said top portion;

(d) support means for supporting said rolled banner in the air;

(e) a large plurality of pieces of confetti contained in said banner in between said rolled layers;

(f) release means for unrolling said banner in the air and releasing said confetti while simultaneously displaying said advertizing indicia; and (g) wherein said support means include a plurality of hangers, and wherein said release means include a release line extending through said plurality of hangers.

8. The confetti-filled banner of claim 7 wherein said release means include first and second release lines, said first and second release lines extending across said width of said banner from opposite sides of said banner.

9. The confetti-filled banner of claim 7 wherein said release means include a release line extending in the direction of said banner width, and motor-operated means for pulling said release line to unroll said banner.

10. The confetti-filled banner of claim 9 wherein said release means include first and second release lines, each of said release lines extending in the direction of said width of said banner, and said first and second release lines extending in opposite directions relative to each other.

11. The confetti-filled banner of claim 10 further including motor driven means for pulling said release lines in said opposite directions.

12. The confetti-filled banner of claim 7 wherein said release means include a plurality of support rings, and said release line extends through said hangers and said support rings.

13. A confetti launching banner comprising:

(a) a banner having a top portion, a width and a length, each of said width and length extending a plurality of feet;

(b) indicia means conveying a message on said banner;

(c) said banner being rolled upon itself to form rolled layers;

(d) retainer means for retaining said banner in rolled layers;

(e) a large plurality of confetti contained in said rolled layers;

(f) support means for supporting said top portion of said banner in a stationary position in the air; and (g) release means for releasing said retainer means and unrolling said banner while said top portion remains held stationary in the air by said support means for launching said confetti and displaying said message.

14. The confetti launching banner of claim 13 further including means for remotely actuating said release means for unrolling said banner and launching said confetti.

15. The confetti launching banner of claim 13 wherein said support means for supporting said rolled banner include a first set of holes in said banner, and wherein said release means for unrolling said banner include a second set of holes in said banner, and a release line extending through said second set of holes.

* * * * *